US010900135B2

(12) United States Patent
Weinberg et al.

(10) Patent No.: US 10,900,135 B2
(45) Date of Patent: Jan. 26, 2021

(54) METHOD AND APPARATUS FOR MANUFACTURING PARTICLES

(71) Applicant: Weinberg Medical Physics, Inc., North Bethesda, MD (US)

(72) Inventors: Irving N. Weinberg, Bethesda, MD (US); Lamar Odell Mair, Washington, DC (US); Pavel Stepanov, North Potomac, MD (US)

(73) Assignee: Weinberg Medical Physics, Inc., North Bethesda, MD (US)

( * ) Notice: Subject to any disclaimer, the term of this patent is extended or adjusted under 35 U.S.C. 154(b) by 0 days.

(21) Appl. No.: 15/427,372

(22) Filed: Feb. 8, 2017

(65) Prior Publication Data

US 2017/0226649 A1 Aug. 10, 2017

Related U.S. Application Data

(60) Provisional application No. 62/292,966, filed on Feb. 9, 2016.

(51) Int. Cl.

| | |
|---|---|
| ***C25D 1/00*** | (2006.01) |
| ***C25D 1/04*** | (2006.01) |
| ***C25D 1/20*** | (2006.01) |

(52) U.S. Cl.

CPC ..... *C25D 1/006* (2013.01)

(58) Field of Classification Search

CPC . C25D 1/00; C25D 1/006; C25D 1/04; C25D 1/20

USPC ..... 205/67, 74, 76

See application file for complete search history.

(56) References Cited

U.S. PATENT DOCUMENTS

| | | | | |
|---|---|---|---|---|
| 3,729,389 A * | 4/1973 | De Angelo et al. | ..... | C25D 5/02 205/118 |
| 4,456,637 A * | 6/1984 | Takeda | ..... | B05C 1/0839 427/355 |
| 5,591,318 A * | 1/1997 | Li | ..... | H01G 9/025 205/205 |
| 5,693,207 A * | 12/1997 | Fromson | ..... | B01J 37/0226 205/112 |
| 5,800,930 A * | 9/1998 | Chen | ..... | C25D 5/16 205/104 |
| 5,910,231 A * | 6/1999 | Kirayoglu | ..... | D21H 5/16 205/104 |
| 6,019,784 A * | 2/2000 | Hines | ..... | C25D 1/00 128/898 |

(Continued)

OTHER PUBLICATIONS

Zhu et al., "Preparation of Ag/Cu Janus Nanowires: Electrodeposition in Track-Etched Polymer Templates," Nuclear Instruments and Methods in Physics Research B (2015), vols. 356-357, pp. 57-61. (Year: 2015).*

(Continued)

*Primary Examiner* — Edna Wong

(74) *Attorney, Agent, or Firm* — Barnes & Thornburg LLP

(57) ABSTRACT

Disclosed embodiments provide a method and apparatus for continuous production of micro/nanoscale particles using roll-to-roll manufacturing in combination with electroplating. The roll-to-roll process can move a mechanically flexible reel stock material along rotating elements designed to position the material for various additive, subtractive, and modification processes. In accordance with at least one embodiment, processes applied at various stations may include sputtering, electroplating, and/or etching.

16 Claims, 5 Drawing Sheets

(56) References Cited

U.S. PATENT DOCUMENTS

| | | | | |
|---|---|---|---|---|
| 2003/0048172 | A1* | 3/2003 | Meigs | H01C 17/16 338/308 |
| 2003/0077310 | A1* | 4/2003 | Pathak | A61F 2/91 424/423 |
| 2008/0061459 | A1* | 3/2008 | Nakajima | B01F 3/0807 264/13 |
| 2008/0236441 | A1* | 10/2008 | Nobe | C25D 3/56 106/1.05 |
| 2010/0303722 | A1* | 12/2010 | Jin | A61L 27/30 424/9.1 |
| 2011/0062112 | A1* | 3/2011 | Saucy | B81C 99/0085 216/52 |
| 2011/0240476 | A1* | 10/2011 | Wang | B82Y 20/00 205/67 |
| 2018/0371631 | A1* | 12/2018 | Sun | C25D 1/006 |

OTHER PUBLICATIONS

Dobrev et al., "Electrochemical Growth of Copper Single Crystals in Pores of Polymer Ion-Track Membranes," Appl. Phys. A (1999), vol. 69, pp. 233-237. (Year: 1999).*

Dobrev et al., "Growth of Iron Single Crystals in the Etched Ion Tracks of Polymer Foils," Appl. Phys. A (2001), vol. 72, pp. 729-733. (Year: 2001).*

* cited by examiner

METHOD AND APPARATUS FOR MANUFACTURING PARTICLES

CROSS REFERENCE AND PRIORITY CLAIM

This patent application claims priority to U.S. Provisional Application Provisional Patent Application No. 62/292,966, entitled "ROLL TO ROLL MANUFACTURE OF INORGANIC PARTICLES USING FLEXIBLE TEMPLATES AND ELECTROPLATING" filed Feb. 9, 2016, the disclosure of which being incorporated herein by reference in their entirety.

FIELD

Disclosed embodiments provide a method and apparatus for manufacturing particles that may be used in medical or industrial applications.

BACKGROUND

Disclosed embodiments utilize a novel combination of roll-to-roll and electroplating techniques to manufacture particles.

Conventional roll-to-roll manufacturing processes rely on moving reel stock of flexible material along rotating elements. Reel stock is a flexible material capable of being rolled onto or off of a rotating element. In some instances, rotating elements can take the form of a spool or spool-like device. Reel stock may be made from a variety of materials, and may be composed of a single material, a composite material, a multilayered material, or a combination of these materials.

As reel stock moves from one rotating element to another rotating element, various processes are performed on the reel stock. Modifications may be made to the reel stock, or newly added coating materials attached to the surface of the reel stock, or embedded in the through-holes of the reel stock. These processes may occur while the reel stock is between rotating elements, or may occur while the reel stock is in contact with a specific rotating element or specific subset of rotating elements. The processes may modify the reel stock by adding material to the reel stock, removing material from the reel stock, deforming material on the reel stock, chemically modifying material on the reel stock, or reorganizing material on the reel stock. Thermal, optical, mechanical, chemical, electrochemical, electrical, or magnetic processes may be used to accomplish reel stock material modifications.

SUMMARY

Disclosed embodiments use template-guided electroplating to manufacture particles using roll-to-roll manufacturing.

Although particle manufacturing using electroplating techniques has been done with individual disk templates, the presently disclosed embodiments provide a novel combination of an electroplating technique for manufacturing particles with a roll-to-roll methodology using continuous rolls of template material instead of individual disk templates. The template material may be initially supplied in the form of reel stock. This reel-to-reel method (also referred to herein as a "roll-to-roll" method) and the associated apparatus disclosed herein enables faster production of particles than conventional, disk-based method, without the need for handling or manipulating template disks.

BRIEF DESCRIPTION OF THE FIGURES

The detailed description particularly refers to the accompanying figures in which.

DETAILED DESCRIPTION

Figure 1:
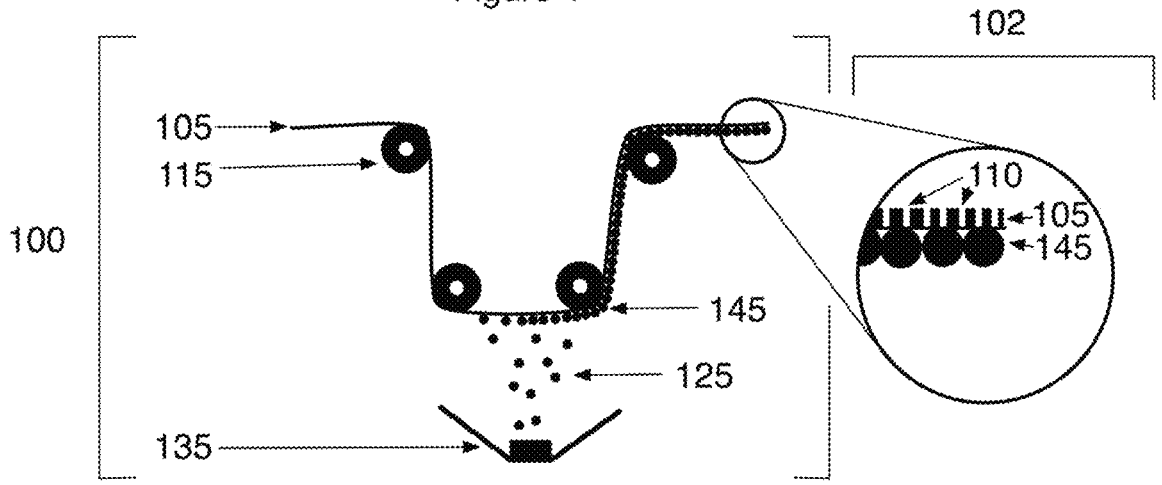
FIG. 1 illustrates an example of a first processing station provided in accordance with the disclosed embodiments.

Disclosed embodiments provide a method and apparatus for continuous production of micro/nanoscale particles using roll-to-roll manufacturing in combination with electroplating. The roll-to-roll process can move a mechanically flexible reel stock material along rotating elements designed to position the material for various additive, subtractive, and modification processes. In accordance with at least one embodiment, processes applied at various stations may include sputtering, electroplating, and/or etching.

Processes provided in accordance with the disclosed embodiments differ from conventional approaches in that the disclosed embodiment processes modify a reel stock material to make it suitable for electroplating at specified locations along the reel stock, then processes that material via roll-to-roll electroplating to generate microscale and nano scale particles. While conventional efforts have generated particles via roll-to-roll syntheses using mechanical filling of reservoirs, vacuum deposition methods, or physical vapor deposition methods, the presently disclosed embodiments provide the first roll-to-roll method for making inorganic particles by electroplating into the through-holes of reel-stock materials. The novelty and inventive nature of the disclosed embodiments is in part due to the disclosed process and apparatus for converting a batch-by-batch synthesis process into a continuous manufacturing process.

Roll-to-roll manufacturing lends itself to the manufacture of products, components, features, and particles with sub-millimeter dimensions due to its continuous production method and potential for a high degree of process automation. However, conventional roll-to-roll manufacturing methods do not use template-guided electroplating to manufacture particles, as in the disclosed embodiments.

One conventional roll-to-roll technique has been termed the Particle Replication in Non-wetting Templates (PRINT) method. The PRINT technology relies on the process of filling reservoirs in non-wetting, patterned templates with liquid phase polymer, solidifying the polymer, then extracting the formed polymer from the reservoir. The process has been reviewed in the publication "Top-down particle fabrication: control of size and shape for diagnostic imaging and drug delivery", by D. A. Canelas, K. P. Herlihy, and J. M. DeSimone, published in the journal WIRES Nanomedicine in 2009 (incorporated herein by reference in its entirety), as well as the article entitled "PRINT: A Novel Platform Toward Shape and Size Specific Nanoparticle Theranostics", by J. L. Perry, K. P. Herlihy, M. E. Napier, and J. M. DeSimone, published in the journal Accounts of Chemical Research in 2011. The PRINT technique has not been used to make solid metal particles (incorporated herein by reference in its entirety).

Template guided electroplating is a technique for making cylindrical particles with a broad range of aspect ratios and materials compositions. Template-guided electroplating first appeared as a method for making particles in the late 1980s, pioneered by early work by Charles R. Martin and Reginald M. Penner, as taught in "Preparation and Electrochemical Characterization of Ultramicroelectrode Ensembles", by R. M. Penner and C. R. Martin, published in the journal Analytical Chemistry, Vol. 59, Issue 21, 1987 (incorporated herein by reference in its entirety). The methods taught by Martin and Penner used discrete, individual discs of template material, which had through-holes extending the full thickness of the template. The cylindrical through-holes were filled with metal (e.g., platinum) using an electroplating technique.

An example of such electroplating involves first coating one face of the template with a conductive material, which when in contact with a cathode forms a working electrode for electrodeposition of ions in a liquid phase electrolyte. After the electrolyte is placed in electrical contact to an anode, an electrical potential is applied so that the ions are reduced (electrodeposition) within the through-holes. Then, the template material is dissolved in order to release the cylindrical particles.

Although particle manufacturing using electroplating techniques has been done with individual disk templates, the presently disclosed embodiments provide a novel combination of an electroplating technique for manufacturing particles with a roll-to-roll methodology using continuous rolls of template material instead of individual disk templates. The template material may be initially supplied in the form of reel stock. This reel-to-reel method (also referred to herein as a "roll-to-roll" method) and the associated apparatus disclosed herein enables faster production of particles than conventional, disk-based method, without the need for handling or manipulating template disks.

In accordance with disclosed embodiments, a manufacturing apparatus may include multiple stations through which reel stock is processed. The reels may be set up so that the reel stock goes continuously from one station to the next, or may be set up so that the reel stock is wound on a roll within one or more stations and then the roll transferred to other stations.

FIG. 1 (with inset 102) shows an example of a first processing station 100 in which reel stock 105 (optionally containing a plurality of through-holes 110) is in contact with four rotating elements 115 at various points along the reel stock. The reel stock 105 moves from left to right in the figure. As the reel stock moves, a coating material 125 is deposited on the reel stock. An example of such coating material is copper having been ejected from a sputtering apparatus 135. Here, deposition of the coating material 125 onto the reel stock may result in the primary coating material on the reel stock 145 serving as an electrically conductive material for subsequent processing operations.

Electroplating may occur in through-holes of one or more reel stock 105 materials. In accordance with at least one embodiment, through-holes 110 may be created in polycarbonate reel-stock 105 prior to placement in station 100 via lithographic processes such as nanoimprint lithography, as taught by S. Y. Chou et al. in their publication, "Imprint Lithography with 25-Nanometer Resolution," published in Science, Vol. 272, 1996. This process may result in uniform through-hole diameters that can be set to be as small as 1 nanometer or as large as 10 microns. In accordance with at least on embodiment, through-holes 110 may be created in polycarbonate reel-stock 105 prior to placement in station 100 via ion irradiation and subsequent etching of track left by the ion in an etchant.

In accordance with at least another embodiment, the through-holes in the one or more reel stocks 105 may be made while the reel stock 105 is on a rotating element. In one example of such an embodiment, light from a laser or other form of radiation may be used to create through-holes in the reel-stock 105, or to initiate the creation of such through-holes that are subsequently enlarged via an etching process. In another embodiment, reel stock 105 is used that already has a conductive metallic layer on one side, thereby eliminated the need for station 100.

In accordance with at least one embodiment, the reel stock 105 may be loaded onto a set of rotating elements that turn and thereby move the reel stock 105 along a path. Reel stock 105 may traverse the path within each station and be moved through other processing stations 100, 200, 300, 400, 500, 600, 700.

In accordance with at one embodiment, the reel stock may begin the process with no conductive surfaces or layers (FIG. 1). In such an embodiment, a deposition process may transfer material from a deposition source 135 to one side of the reel stock 105, creating a primary coating material 145. In accordance with at least one embodiment, the primary coating material 145 may be deposited onto the reel stock 105 by a physical vapor deposition technique, such as sputtering. In an embodiment of the process, the primary coating material 145 may partially or fully seal one opening of one or more of the through-holes 110.

In accordance with at least one embodiment, the primary coating material 145 may serve as an electrical contact for one or more subsequent electroplating processes.

Figure 2:
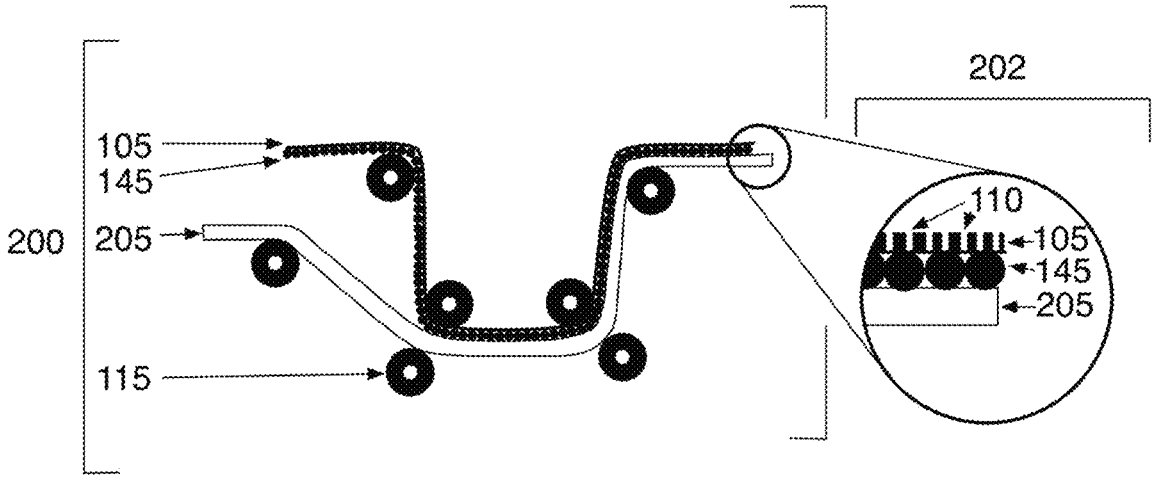
FIG. 2 illustrates an example of a second processing station provided in accordance with the disclosed embodiments.

FIG. 2 (with inset 202) shows an example of a second processing station 200 in which a layer of secondary coating material 205 is applied mechanically to the same side of the reel stock as the primary coating material 145. In at least one embodiment, the secondary coating material 205 may be an electrically conductive material, which is more robust mechanically than the primary coating material 145. In an alternative embodiment, the second processing station may not be needed, and electrical contact may be made to the primary coating material 145.

At the second processing station (FIG. 2, 200) a secondary coating material 205 is mechanically rolled onto the primary coating material 145 that was previously deposited on reel-stock 105. In an embodiment of the process, the secondary coating material 205 may be an electrically conductive foil, such as copper. In such an embodiment, the electrically conductive foil may be wider than the width of the reel stock 105, and one edge of the reel stock may be aligned with one edge of the electrically conductive foil. Thus, after the two layers (145 and 205) are combined, there may exist a side of the electrically conductive foil that extends beyond the width of the reel stock.

Figure 3:
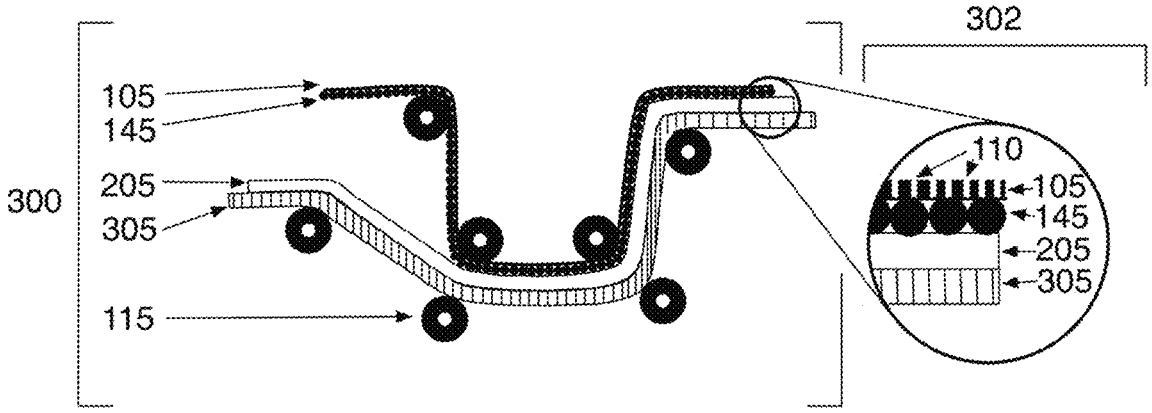
FIG. 3 illustrates an example of a third processing station provided in accordance with the disclosed embodiments.

FIG. 3 (with inset 302) shows an example of a third processing station 300 in which a layer of tertiary coating material 305 applied mechanically to the same side of the reel stock as the primary coating material 145 and the secondary coating material 205. In at least one embodiment of the process, the tertiary coating material 305 may be an electrically insulating material. The coating 305 may enable a subsequent electrolyte deposition to only make contact to the primary electrically-conductive coating material 145 via the other side of the reel stock (i.e., the side opposite from coating 305).

Thus, at the third processing station (FIG. 3 300), the tertiary coating material 305 may be mechanically applied onto the secondary coating material 205. In accordance with at least one embodiment, the tertiary coating material 305 may be electrically insulating, for example, polycarbonate. In such an embodiment, after passing through the third station 300, the reel-to-reel material may be composed of a multilayered material assembly, including the reel stock 105, an electrically conductive primary coating layer 145, and an electrically conductive secondary coating layer 205, and an electrically insulating laminate coating 305. In an embodiment of the process, the electrically insulating laminate layer 305 may seal only one face and both edges of the electrically conductive secondary foil 205.

Figure 4:
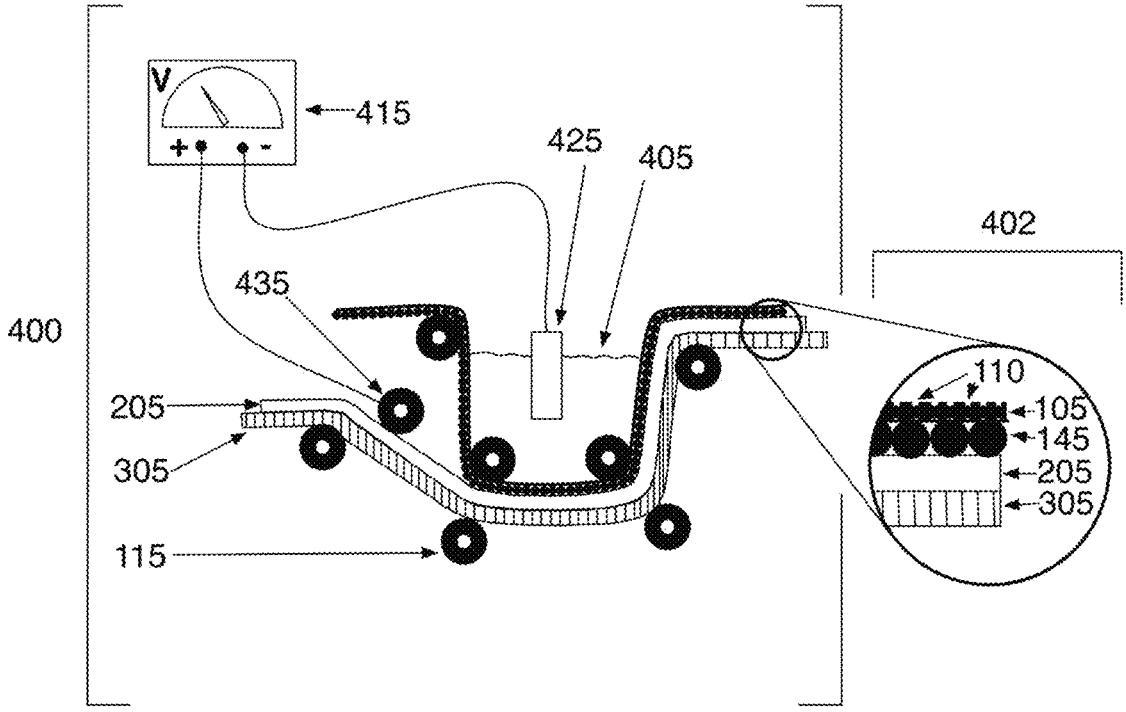
FIG. 4 illustrates an example of a fourth processing station provided in accordance with the disclosed embodiments.

FIG. 4 (with inset 402) shows an example of a fourth processing station 400, in which a region of the reel stock 105 may be submerged into an electrolyte solution bath 405 containing metallic ions for electroplating. A variable power supply 415 may be attached to an anode 425, which is partially submerged in the electrolyte solution bath 405.

In at least one embodiment, the secondary coating material 205 and primary coating material 145 may both be electrically conductive materials; thus, electrical contact with secondary coating material 205 may be made by a rotating cathode 435. Since secondary coating material 205 is in contact with primary coating material 145, there is also electrical contact between the rotating cathode 435 and the primary coating material 145. Electrical deposition of material from the electrolyte into the through-hole 110 and onto primary coating material 145 may occur in this processing station.

Thus, at the fourth processing station (FIG. 4, 400), electroplating may be performed inside a multiplicity the through-holes 110 of reel stock 105. Electroplating may be achieved by immersing the reel stock 105 and its coatings 145, 205, 305 in an electrolytic bath 405 containing ions suitable for electroplating (for example, iron ions).

In accordance with at least one embodiment, the only electrically conductive material that the electrolytic bath comes into direct contact with is the conductive primary coating layer 145 inside the through-holes of the reel stock 105. In accordance with at least one embodiment, a dedicated electrical contact rotating element 435 may be placed in contact with the secondary coating material 205. In accordance with at least one embodiment, the secondary coating material 205 may be used as the electrical contact to the primary coating material 145. By connecting a voltage source 415 to the electrical contact rotating element 435 and submerging an anode 425 (which may be made of platinum foil) in the electroplating solution 405, a bias may be applied between the anode 425 and the electrical contact rotating element. This bias may initiate electrochemical reduction of ions from the electrolytic bath at the surface of the primary coating material 145 which is in the through-holes of the reel stock 105.

In accordance with at least one embodiment, electroplating may be performed while the reel stock moves continuously through the electroplating bath station 400. It is understood that the electroplating may be adjusted in duration and magnitude through adjustment of bias voltage, reel speed, or other factors. Such adjustment could be used to selectively plate sections of the multilayered material assembly.

It is understood that the electrolyte bath 405 may contain drugs or other molecules that are co-deposited with the electrolyte ions within a multiplicity of through-holes 110. These drugs or other materials may elute from the particles after the rinsing stations 700.

Figure 5:
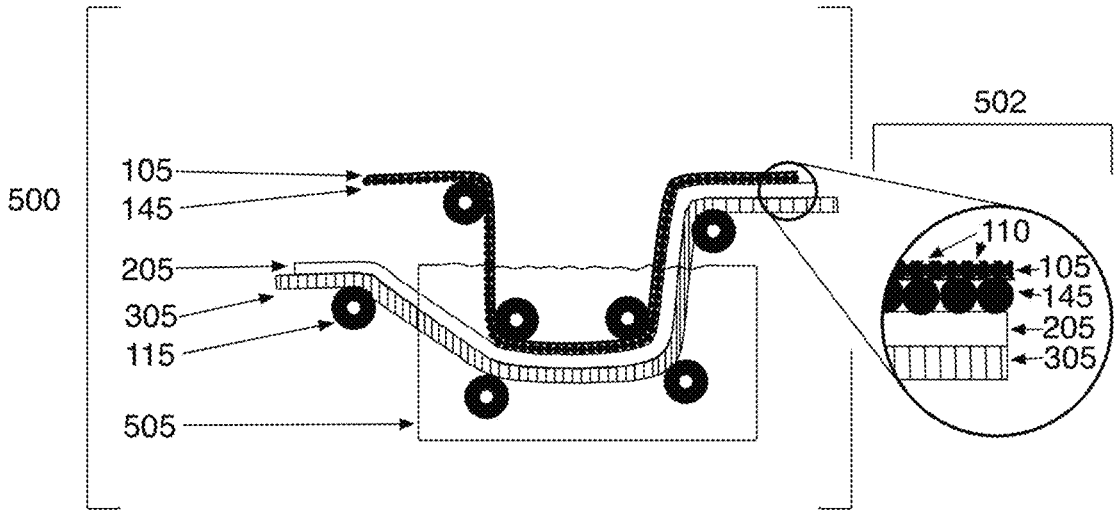
FIG. 5 illustrates an example of a fifth processing station provided in accordance with the disclosed embodiments.

FIG. 5 (with inset 502) shows an example of a fifth processing station 500, in which one or both sides of the reel stock may be rinsed in a water rinse bath 505. Thus, at the fifth processing station (FIG. 5, panel 500), the multilayered assembly may be immersed in a circulating bath of water 505, removing electrolytic solution adherent to the reel stock 105 or other components on the multilayered assembly.

Figure 6:
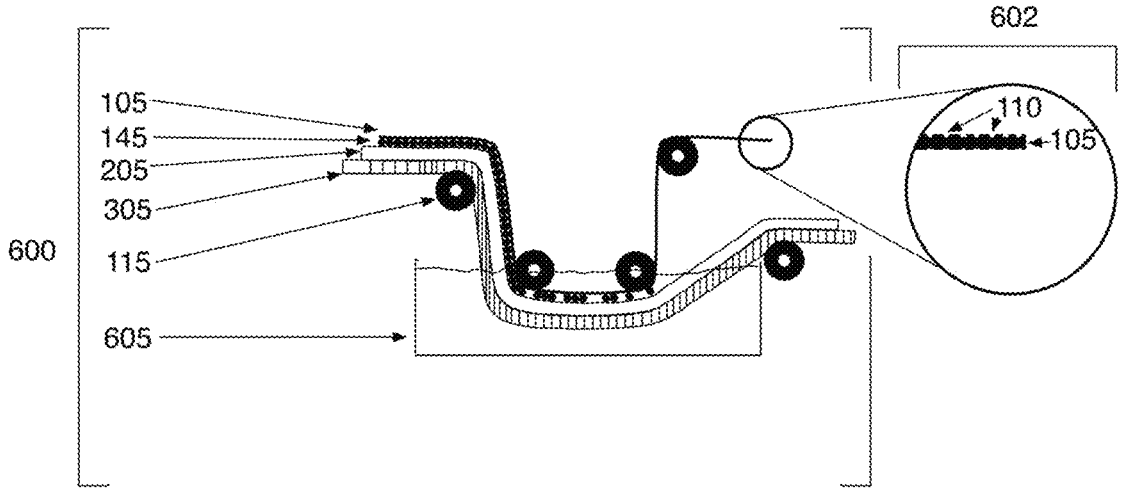
FIG. 6 illustrates an example of a sixth processing station provided in accordance with the disclosed embodiments.

FIG. 6 (with inset 602) shows an example of a sixth processing station 600, where the primary coating material 145 is removed from the reel stock by action of an etching bath 605 removal of the primary coating material 145. Removal of the primary coating material 145 may also result in separation of the reel stock 105 from the secondary coating material 205 and tertiary coating material 305.

Thus, at the sixth processing station (FIG. 6, panel 600), the primary coating layer 145 is etched or dissolved. In the process of doing so, the reel stock 105 and the materials electroplated in the through-holes of the reel stock are dissociated from the other coating layers.

Figure 7:
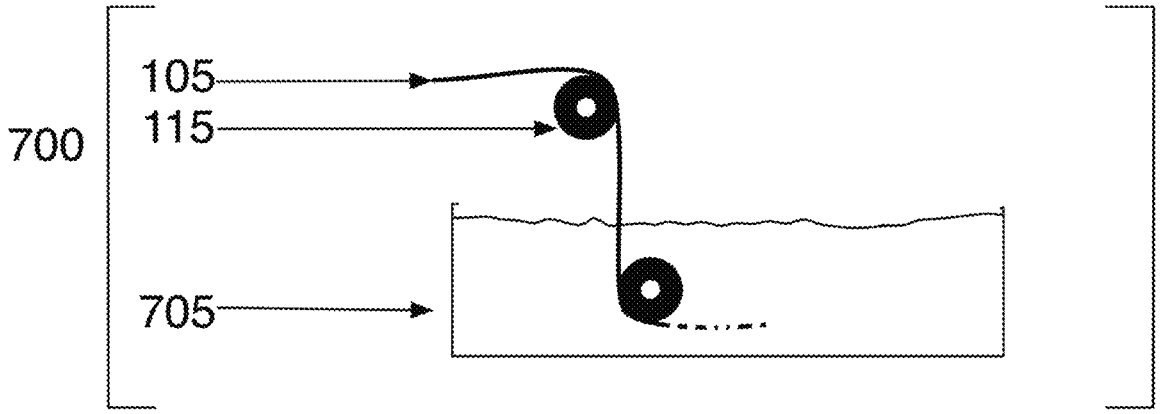
FIG. 7 illustrates an example of a seventh processing station provided in accordance with the disclosed embodiments.

FIG. 7 shows an example of a seventh processing station 700, in which the reel stock 105 is dissolved by submerging the reel stock 105 in a reel stock etchant bath 705. Thus, at the seventh processing station (FIG. 7, panel 700), the reel stock 105 is etched or dissolved in an etchant bath 705. In the case of reel stock 105 made from polycarbonate track etched (PCTE) material, reel stock 105 dissolution may be done in acetone or dimethylformamide. Dissolving the reel stock 105 separates the particles previously electroplated into the through-holes from the reel stock 105. The resulting particles may be collected by filtration or magnetic separation or other processes. It is understood that the rinsing station 700 may be used to coat the particles, or that the coating may be applied in another station.

Figure 8:
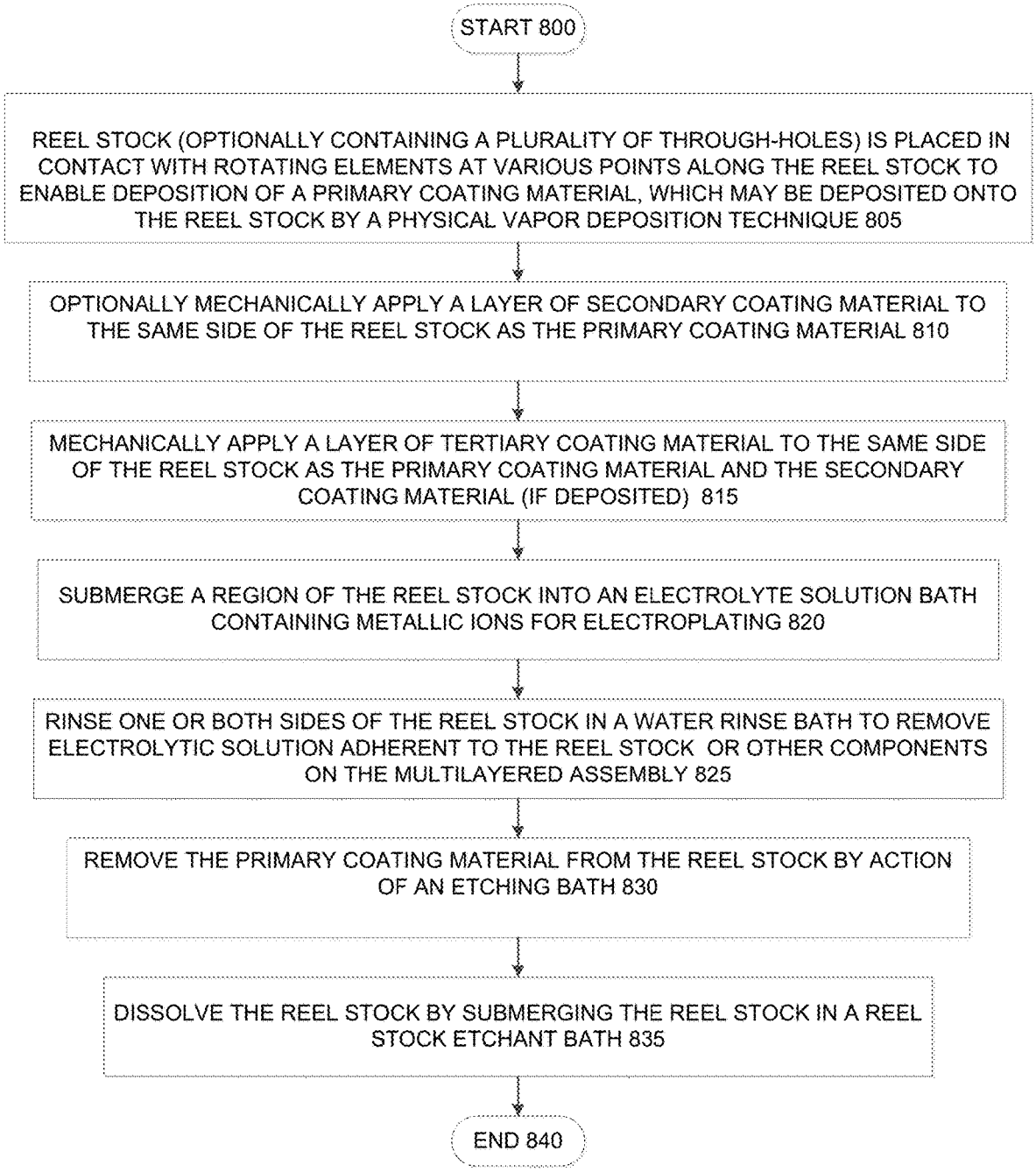
FIG. 8 includes a flowchart that illustrates an example of a processing method performed in accordance with the disclosed embodiments.

FIG. 8 includes a flowchart that illustrates an example of a processing method performed in accordance with the disclosed embodiments. As shown in FIG. 8, operations begin at 800 and control proceeds to 805 at which reel stock (optionally containing a plurality of through-holes) is placed in contact with rotating elements at various points along the reel stock to enable deposition of a primary coating material, which may be deposited onto the reel stock by a physical vapor deposition technique, such as sputtering. Control then proceeds to 810, at which the process mechanically applies a layer of secondary coating material to the same side of the reel stock as the primary coating material. Note, in an alternative embodiment, this application of the secondary coating may not be needed, and electrical contact may be made to the primary coating material. Control then proceeds to 815, at which a layer of tertiary coating material is applied mechanically to the same side of the reel stock as the primary coating material and the secondary coating material (if deposited).

Control then proceeds to 820, at which a region of the reel stock may be submerged into an electrolyte solution bath containing metallic ions for electroplating, as explained above in connection with the fourth processing station (FIG. 4, 400). Control then proceeds to 825, at which one or both sides of the reel stock may be rinsed in a water rinse bath to remove electrolytic solution adherent to the reel stock or other components on the multilayered assembly.

Control then proceeds to 830, at which the primary coating material is removed from the reel stock by action of an etching bath. Control then proceeds to 835, at which the reel stock may be dissolved by submerging the reel stock in a reel stock etchant bath.

Control then proceeds to 840, at which the operations are completed.

It should be understood that the operations explained herein may be implemented in conjunction with, or under the control of, one or more general purpose computers running software algorithms to provide the presently disclosed functionality and turning those computers into specific purpose computers.

Moreover, those skilled in the art will recognize, upon consideration of the above teachings, that the above exemplary embodiments may be based upon use of one or more programmed processors programmed with a suitable computer program. However, the disclosed embodiments could be implemented using hardware component equivalents such as special purpose hardware and/or dedicated processors. Similarly, general purpose computers, microprocessor based computers, micro-controllers, optical computers, analog computers, dedicated processors, application specific circuits and/or dedicated hard wired logic may be used to construct alternative equivalent embodiments.

Moreover, it should be understood that control and cooperation of the above-described components may be provided using software instructions that may be stored in a tangible, non-transitory storage device such as a non-transitory computer readable storage device storing instructions which, when executed on one or more programmed processors, carry out the above-described method operations and resulting functionality. In this case, the term non-transitory is intended to preclude transmitted signals and propagating waves, but not storage devices that are erasable or dependent upon power sources to retain information.

Those skilled in the art will appreciate, upon consideration of the above teachings, that the program operations and processes and associated data used to implement certain of the embodiments described above can be implemented using disc storage as well as other forms of storage devices including, but not limited to non-transitory storage media (where non-transitory is intended only to preclude propagating signals and not signals which are transitory in that they are erased by removal of power or explicit acts of erasure) such as for example Read Only Memory (ROM) devices, Random Access Memory (RAM) devices, network memory devices, optical storage elements, magnetic storage elements, magneto-optical storage elements, flash memory, core memory and/or other equivalent volatile and non-volatile storage technologies without departing from certain embodiments. Such alternative storage devices should be considered equivalents.

While certain illustrative embodiments have been described, it is evident that many alternatives, modifications, permutations and variations will become apparent to those skilled in the art in light of the foregoing description. Accordingly, the various embodiments of, as set forth above, are intended to be illustrative, not limiting. Various changes may be made without departing from the spirit and scope of the invention.

For example, although the figures illustrate deposition of a single material from electrolyte bath 405 it should be understood that the stations and processes may be repeated in order to deposit and/or remove additional materials within the through-holes.

Additionally, optionally, the secondary coating material may be composed of an electrically conductive foil that has been previously laminated with an insulating layer on one side, thereby eliminating the need for the third processing station.

In accordance with at least one embodiment, a non-conductive material can be inserted into one or more through-holes after the electroplating operation.

In accordance with at least one embodiment, the applied electroplating bias is constant. In accordance with at least one embodiment, the applied electroplating bias varies over the course of time. In accordance with at least one embodiment, the electroplated materials include conducting or semiconducting materials. In accordance with at least one embodiment, the electroplated materials are alloys composed of multiple elements, composed of magnetic materials, are conducting polymers, and/or incorporate polymers. In accordance with at least one embodiment, non-conductive materials are co-deposited with the electroplated materials. In accordance with at least one embodiment, the non-conductive materials may elute from the processed particles.

In accordance with at least one embodiment, an apparatus comprising at least one station in which material may be deposited in a multiplicity of through-holes in moving reel-stock via electroplating.

The invention claimed is:

1. A method for manufacturing particles having sub-millimeter dimensions, the method comprising:

providing a roll-to-roll processing apparatus having rotating elements with a flexible reel stock having a plurality of lithographically-etched through-holes, applying an electrically conductive primary coating material by vapor deposition to one side of the flexible reel stock on the roll-to-roll processing apparatus, mechanically rolling an electrically conductive secondary coating material onto the primary coating material on the roll-to-roll processing apparatus, mechanically applying a tertiary electrically insulating material to the same side of the reel stock as the primary coating material and the secondary coating material, rotating the rotating elements to move the flexible reel stock along the rotating elements and through an electrolyte solution containing metallic ions, electroplating materials into through-holes in the flexible reel stock when a region of the flexible reel stock is submerged into the electrolyte solution containing metallic ions to form particles attached to flexible reel stock, and dissolving the flexible reel stock by submerging the reel stock in a reel stock etching bath to release particles electroplated into each of the through-holes of the reel stock.

2. The method of claim 1, wherein the flexible reel stock is moving during the electroplating of materials.

3. The method of claim 1, in which an applied electroplating bias is constant.

4. The method of claim 1, in which an applied electroplating bias varies over time.

5. The method of claim 1, in which the electroplated materials further include conducting or semiconducting materials.

6. The method of claim 1, in which the electroplated materials further include alloys composed of multiple elements.

7. The method of claim 1, in which the electroplated materials further include magnetic materials.

8. The method of claim 1, in which the electroplated materials further include conducting polymers or incorporate polymers.

9. The method of claim 1, in which the reel stock is moved in a continuous fashion or an intermittent fashion.

10. The method of claim 1, wherein non-conductive materials are co-deposited with the metallic ions.

11. The method of claim 1, wherein the through-holes are created prior to rotation by lithographically-etching the reel stock, or wherein the through-holes are made while the reel stock is on a rotating element.

12. The method of claim 1, wherein the flexible reel stock is an electrically insulating polycarbonate reel stock.

13. The method of claim 1, wherein the through-holes are generated by subsequent chemical etching.

14. The method of claim 1, wherein the creation or initiation of the through-holes are made by a laser while the reel stock is on a rotating element.

15. The method of claim 1, wherein drugs are added to the electrolyte solution to be electroplated into the through-holes of the reel stock.

16. The method of claim 1, wherein the through-holes each have a diameter in a range of 1 nanometer to 10 microns.

* * * * *